US011173624B2

(12) United States Patent
Hall

(10) Patent No.: US 11,173,624 B2
(45) Date of Patent: Nov. 16, 2021

(54) ROUTER BASE HAVING ADJUSTABLE MOUNTING SLOTS

(71) Applicant: Taylor James Hall, Palatine, IL (US)

(72) Inventor: Taylor James Hall, Palatine, IL (US)

(73) Assignee: Nomis LLC, Palatine, IL (US)

( * ) Notice: Subject to any disclaimer, the term of this patent is extended or adjusted under 35 U.S.C. 154(b) by 285 days.

(21) Appl. No.: 15/973,740

(22) Filed: May 8, 2018

(65) Prior Publication Data

US 2018/0326611 A1 Nov. 15, 2018

Related U.S. Application Data

(60) Provisional application No. 62/503,738, filed on May 9, 2017.

(51) Int. Cl.
*B27C 5/10* (2006.01)

(52) U.S. Cl.
CPC ..... *B27C 5/10* (2013.01)

(58) Field of Classification Search
CPC .... B27C 5/00; B27C 5/10; B27C 5/04; B23C 1/20; Y10T 409/306608; Y10T 409/306552
USPC ..... 144/136.95
See application file for complete search history.

(56) References Cited

U.S. PATENT DOCUMENTS 4,143,691 A * 3/1979 Robinson ..... B27C 5/10 144/136.95
4,319,615 A * 3/1982 Ditmanson ..... B23Q 35/105 144/144.1
4,685,496 A * 8/1987 Livick ..... B23Q 9/0035 144/136.95
4,977,938 A * 12/1990 Greeson ..... B23Q 9/0035 144/136.95
5,052,454 A * 10/1991 Meinhardt ..... B23Q 9/0078 144/136.95
5,715,880 A * 2/1998 Tucker ..... B23Q 3/002 144/134.1

(Continued)

FOREIGN PATENT DOCUMENTS

DE 100 26 028 5/2000
EP 0469344 A1 2/1992

(Continued)

OTHER PUBLICATIONS

Trend Routing Technology; 2002 Routing Catalogue; 2002; 5 pages.

(Continued)

*Primary Examiner* — Matthew Katcoff
*Assistant Examiner* — Smith Oberto Bapthelus
(74) *Attorney, Agent, or Firm* — Reinhart Boerner Van Deuren P.C.

(57) ABSTRACT

An attachment for a router having a bit is provided. The attachment includes a frame, a first mounting aperture and a second mounting aperture. The frame member has a top side and a bottom side. The frame member has an opening therethrough configured to receive the bit therethrough when the router is attached to the top side of the frame member. The second mounting aperture is in the form of a mounting slot being adjustably positioned relative to the first mounting aperture to change an orientation of the second mounting aperture relative to the frame member and the first mounting aperture.

11 Claims, 6 Drawing Sheets

(56) References Cited

U.S. PATENT DOCUMENTS

| | | | | |
|---|---|---|---|---|
| 6,305,447 | B1 * | 10/2001 | Rousseau | B27C 5/02 144/135.2 |
| 6,505,659 | B1 * | 1/2003 | Hummel | B27C 5/02 144/135.2 |
| 6,520,224 | B2 * | 2/2003 | Smith | B27C 5/02 144/135.2 |
| 7,089,978 | B2 * | 8/2006 | Karkosch | B23Q 9/0014 144/136.95 |
| 9,726,469 | B2 * | 8/2017 | Adkins | B25H 7/02 |
| 2003/0113180 | A1 * | 6/2003 | Schelberg | B23B 3/00 409/179 |
| 2005/0072491 | A1 * | 4/2005 | Baber | B25F 5/029 144/136.95 |
| 2005/0279424 | A1 * | 12/2005 | Rosendahl | B27C 5/02 144/371 |
| 2006/0037667 | A1 * | 2/2006 | Karkosch | B27C 5/10 144/48.6 |
| 2006/0086425 | A1 * | 4/2006 | Hyde | B27C 9/02 144/286.5 |
| 2006/0157155 | A1 * | 7/2006 | Robinson | B44B 3/02 144/136.95 |
| 2006/0191595 | A1 * | 8/2006 | Stoffel | B27C 5/10 144/136.95 |
| 2009/0050236 | A1 * | 2/2009 | Thorson | B27C 5/10 144/135.2 |
| 2010/0206430 | A1 * | 8/2010 | Pozgay | B23Q 9/0028 144/136.95 |

FOREIGN PATENT DOCUMENTS

| | | | |
|---|---|---|---|
| EP | 0469538 | A1 | 2/1992 |
| EP | 0545142 | A1 | 6/1993 |
| EP | 0546376 | B1 | 2/1997 |
| WO | WO 90/03248 | A1 | 4/1990 |

OTHER PUBLICATIONS

Bosch Industrial Shop Router, Model 0601617739; Jul. 1998; 2 pages; Robert Bosch Tool Corporation.

Bosch Consumer Information; manual; May 20, 2003; 68 pages; Robert Bosch Tool Corporation.

Festool; So Schnell Gibt's Keine Bessere!; Obefräse OF 1400—setzt neue Maβstäbe in ihrer-Klasse, Werkzeuge Für höchste Ansprüche; brochure; Feb. 2004; 4 pages; TTS Systems AG & Co., Wendlingen, DE.

* cited by examiner

ROUTER BASE HAVING ADJUSTABLE MOUNTING SLOTS

CROSS-REFERENCE TO RELATED PATENT APPLICATION

This patent application claims the benefit of U.S. Provisional Patent Application No. 62/503,738, filed May 9, 2017, the entire teachings and disclosure of which are incorporated herein by reference thereto.

FIELD OF THE INVENTION

This invention generally relates to hand tools and more particularly to routers and even more particularly to attachments for routers.

BACKGROUND OF THE INVENTION

A router is a well-known rotary cutting tool for a routing a work piece. Typically, a router has a rotating bit, which is used to cut material such as wood. It is often desirable to attach attachments to the router. For instance, the router could be attached to a base that includes handles for improved manipulation of the router. Alternatively, the router could be attached to attachments that improve the functionality such as circle compasses or devices for allowing the router to cut a straight slot in a piece of wood.

The present invention is directed towards improvements over the prior art, and particularly for attachments for routers.

BRIEF SUMMARY OF THE INVENTION

An attachment for a router having a bit is provided. The attachment includes a frame, a first mounting aperture and a second mounting aperture. The frame member has a top side and a bottom side. The frame member has an opening therethrough configured to receive the bit therethrough when the router is attached to the top side of the frame member. The second mounting aperture is in the form of a mounting slot being adjustably positioned relative to the first mounting aperture to change an orientation of the second mounting aperture relative to the frame member and the first mounting aperture.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
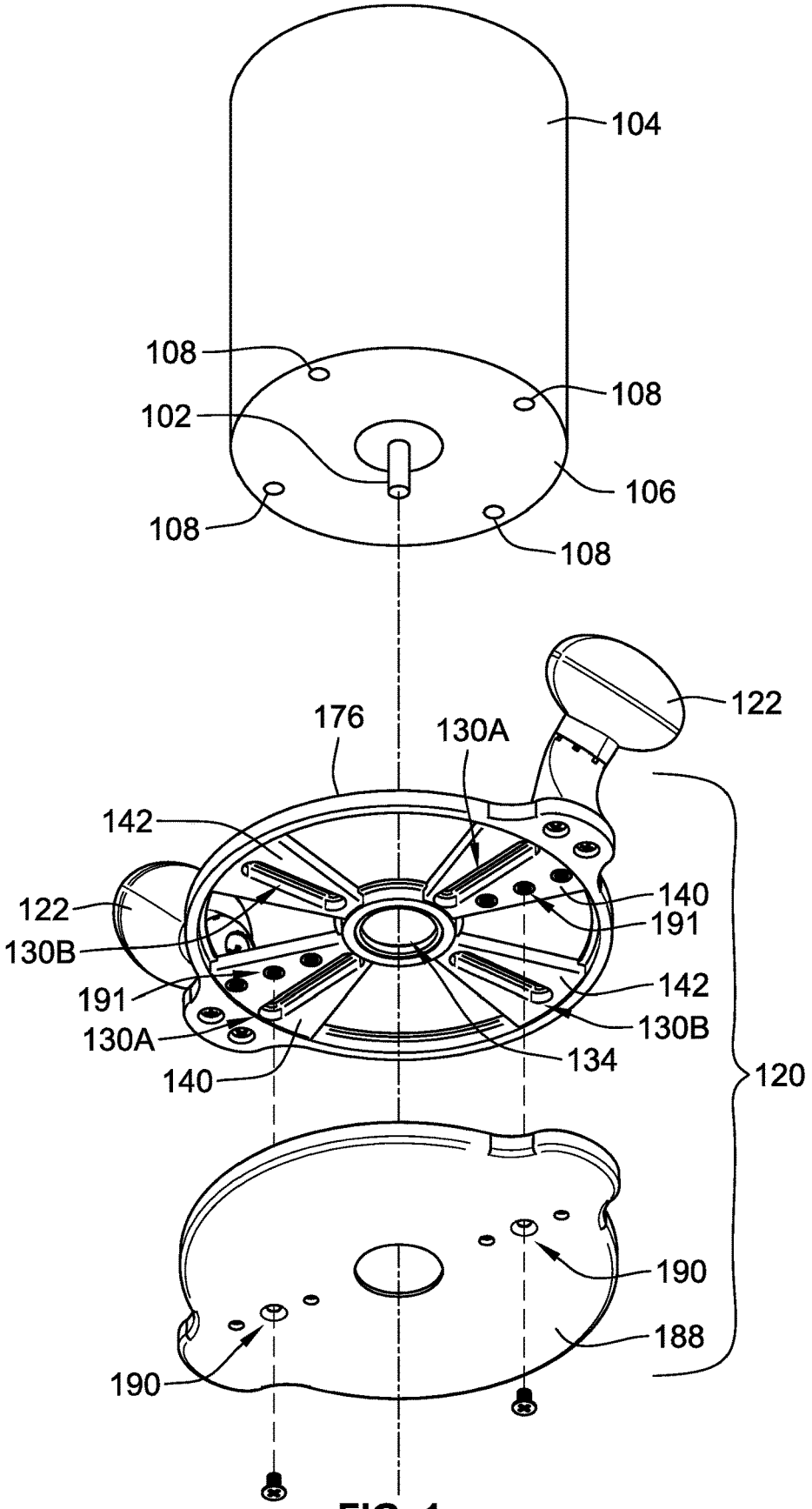
FIG. 1 is a perspective exploded illustration of a schematic router and an attachment to be attached to the router.
Figure 2:
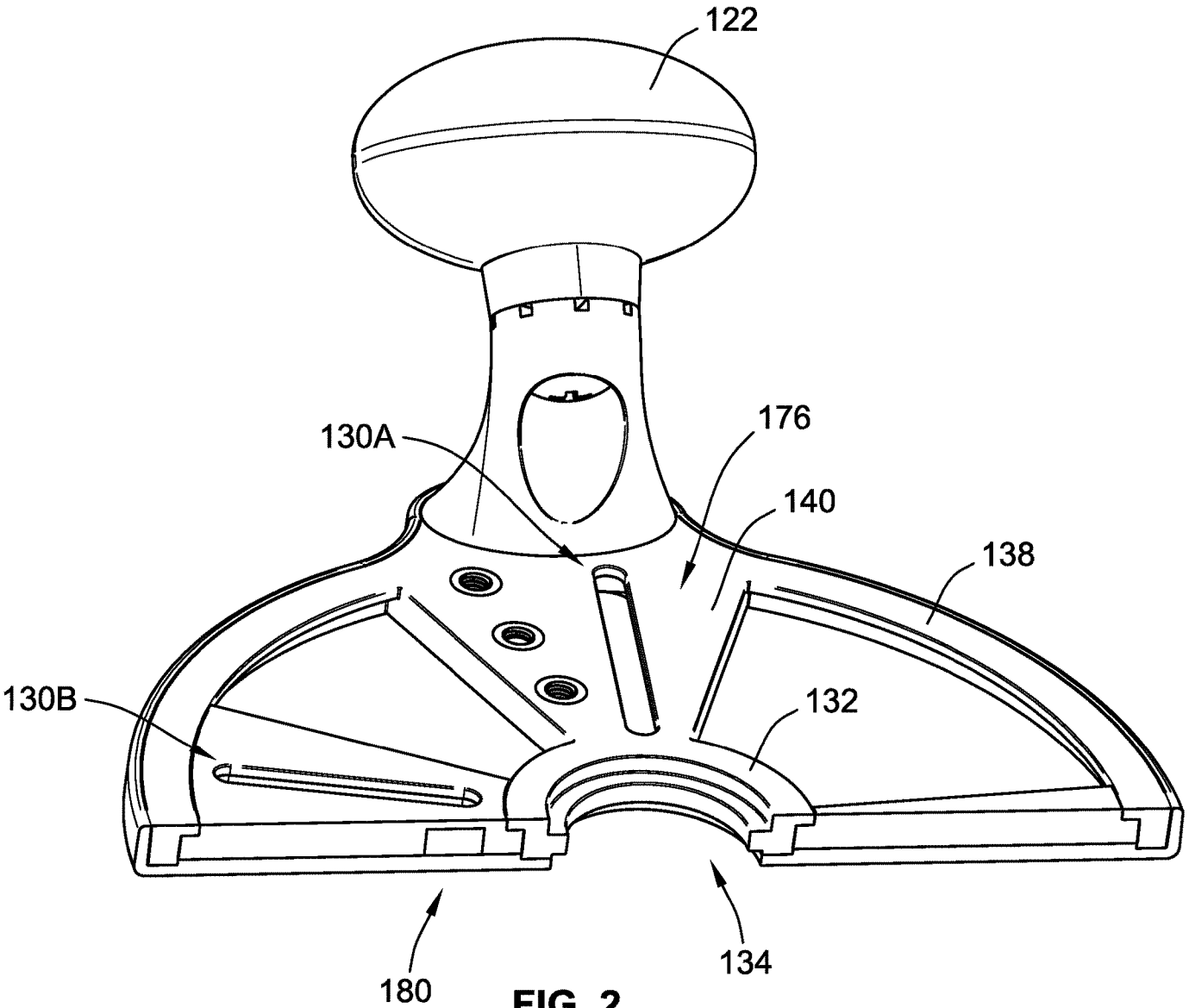
FIG. 2 is a cross-sectional illustration of the attachment of FIG. 1.
Figure 3:
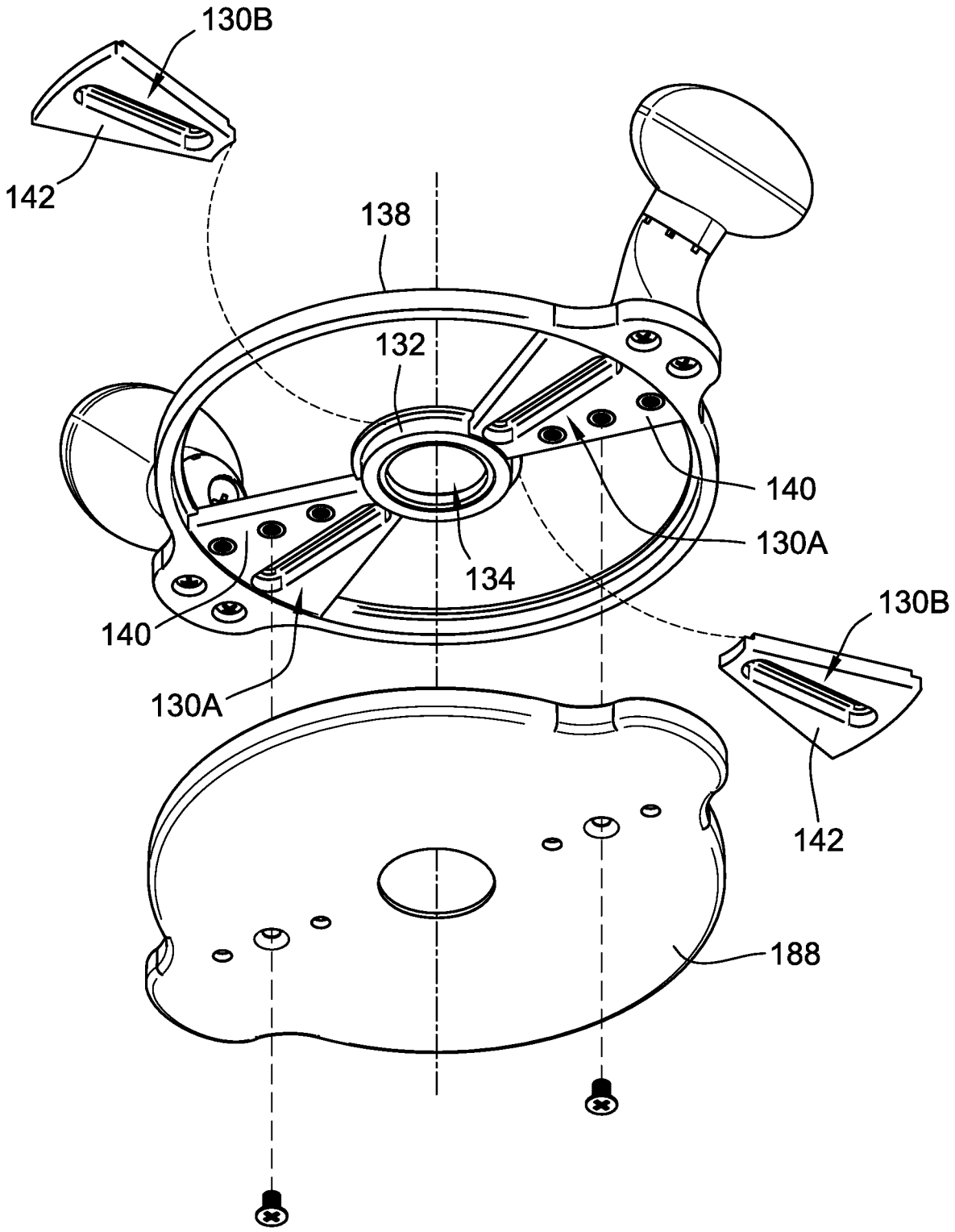
FIG. 3 is an exploded illustration of the attachment of FIG. 1.

FIG. 1 illustrates a schematic router 100 that includes a rotating bit 102. The router 100 includes a housing 104 that may house the motor and electronics for the router 100.

A bottom end 106 of the router 100 includes a plurality of mounting apertures 108. Typically, the mounting apertures 108 are threaded for receipt of bolts/screws to attach attachment to the router 100 and particularly the housing 104 thereof. While the illustrate router 100 includes four (4) mounting apertures 108 other routers could have a different number of mounting apertures 108 and/or a different pattern of the mounting apertures 108. It is typical for individual manufactures to have their own distinct pattern and/or orientation. As there are a large number of manufacturers that manufacture various different routers, a large number of patterns for the mounting apertures in the industry exist.

FIG. 1 illustrates an attachment for router 100 in the form of a base 120 that can be attached proximate the bottom end 106 of the router 100. The base 120 includes a plurality of handles 122 that the user can use to better grip the router 100 and provide better control of the router to make more precise cuts and operation of the router 100. The handles 122 are spaced apart from one another on opposite sides.

The base 120 includes a frame member 124 to which the handles 122 are attached by screws. However, in other embodiments, other attachment mechanisms such as adhesive or simple snap attachment could be provided. Further, in some embodiments, the handles 122 and frame member 124 could be a single monolithic piece, e.g. molded a single molded component.

The base 120 is designed to be able to be attached to a large number of routers 100, regardless of the pattern of the mounting apertures 108. In this embodiment, the base 120 includes four mounting apertures in the form of four mounting slots (referred to generically with reference number 130 and particularly with additional letters following the reference number) through which bolts/screws can extend that will thread into mounting apertures 108. The bolts/screws will secure the base 120 to the router 100.

The frame member 124 defines a central hub 132 that defines a central aperture 134 through which the bit 102 extends. The frame member 124 also includes an outer rim 138 that surrounds the central hub 132. The mounting slots 130 are angularly spaced around the central hub 132 and generally radially interposed between the central hub 132 and outer rim 138.

The mounting slots 130 are formed in radially extending permanent spoke members 140 and radially extending adjustable spoke members 142. Permanent spoke members 140 are permanently attached to the central hub 132 and outer rim 138, e.g. molded with the central hub 132 and outer rim 138 in fixed orientations relative to the central hub 132 and outer rim 138. However, other embodiments could have the permanent spoke members formed as separate components that are otherwise affixed to the central hub 132 and outer rim 138. Adjustable spoke members 142 are movable components, and preferably removable components, that do not have a fixed orientation relative to the central hub 132 and outer rim 138.

It has been determined that, typically, only three bolts/screws are required to attach an attachment to a router even if more mounting apertures are provided by the router. As such, the base 120 can be mounted to the router with substantially any mounting aperture pattern. Typically, one of the mounting slots 130A formed in the permanent spoke members 140 will be used and at least one of the mounting slots 130B formed in the two adjustable spoke members 142 will be used for mounting. Preferably, both permanent spoke members 140 are used. However, this may not be possible for a given hole pattern.

More particularly, to attach the base 120, the base 120 will typically first be attached to router 100 using mounting slot 130A, i.e. one of the permanent spoke members 140. Then, if the router mounting hole pattern allows (e.g. the router mounting hole pattern has two mounting holes offset from one another by 180 degrees), slot 130A of the other permanent spoke member 140 will be used for a second attachment point. Then, the mounting slots 130B of the two adjustable spoke members 142 will be aligned with remaining mounting apertures to secure the base 120 to the router 100. If the second permanent spoke member 140 cannot be used (e.g. properly aligned), then two of the adjustable spoke members 142 would be used.

Figure 4:
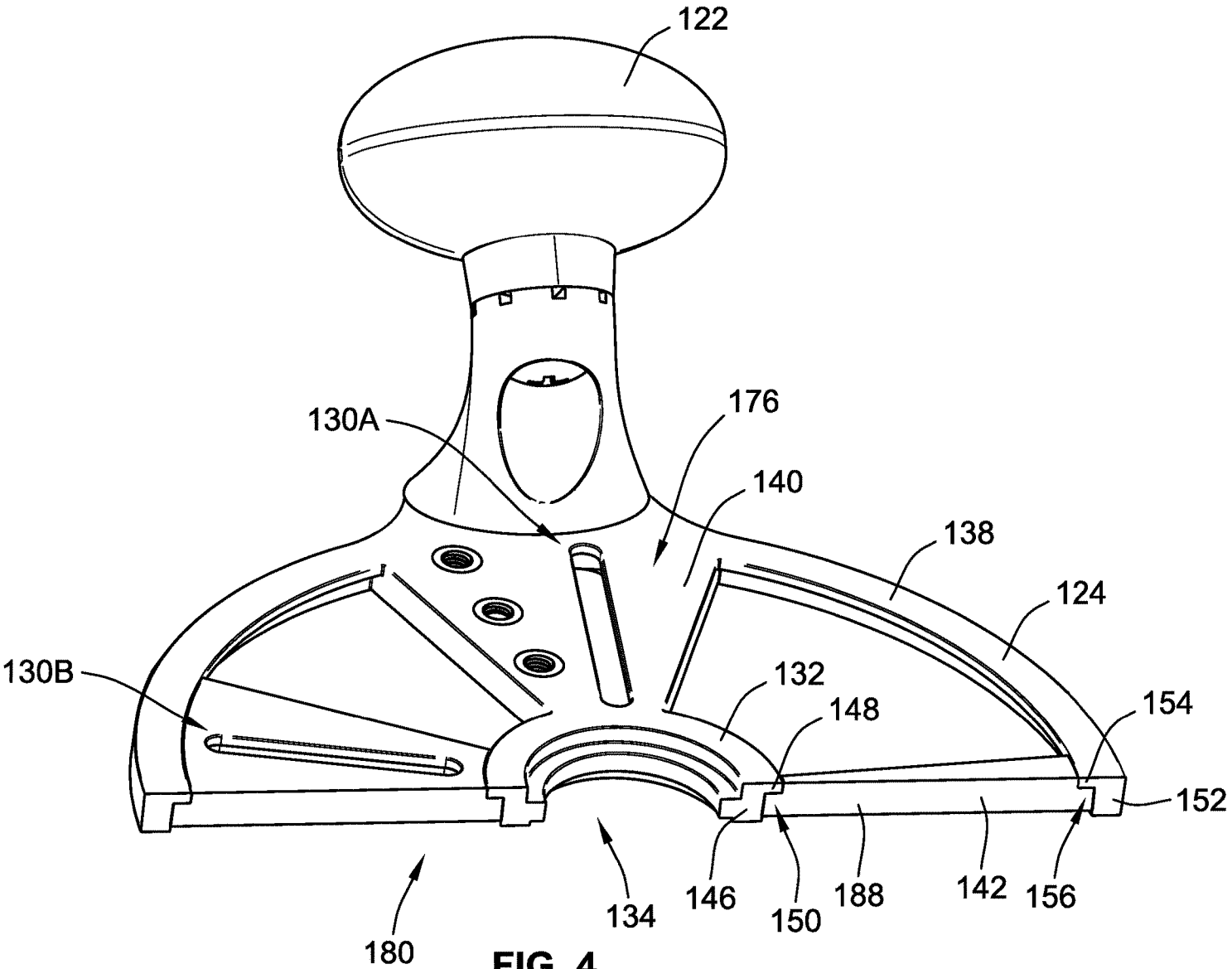
FIG. 4 is an enlarged cross-sectional illustration of the attachment of FIG. 1.

With reference to FIG. 4, the central hub 132 and outer rim 138 each have a generally stepped profile that engage with corresponding ends of the adjustable spoke members 142 while allowing for adjusting the angular position of the adjustable spoke members 142 about the central aperture 134. More particularly, the central hub 132 includes an annular wall portion 146 and a radially outward extending flange 148 that defines a stepped region 150. Similarly, the out rim 138 includes an annular wall portion 152 and a radially inward extending flange 154 that defines a stepped region 156.

The radially inner end 160 and radially outer end 162 of the adjustable spoke members 142 are configured to cooperate with the central hub 132 and outer rim 138, respectively, to axially secure the base 120 to the router 100. More particularly, the adjustable spoke members 142 will clamp the base 120 and particularly the frame member 124 to the bottom end 106 of the router.

Figure 5:
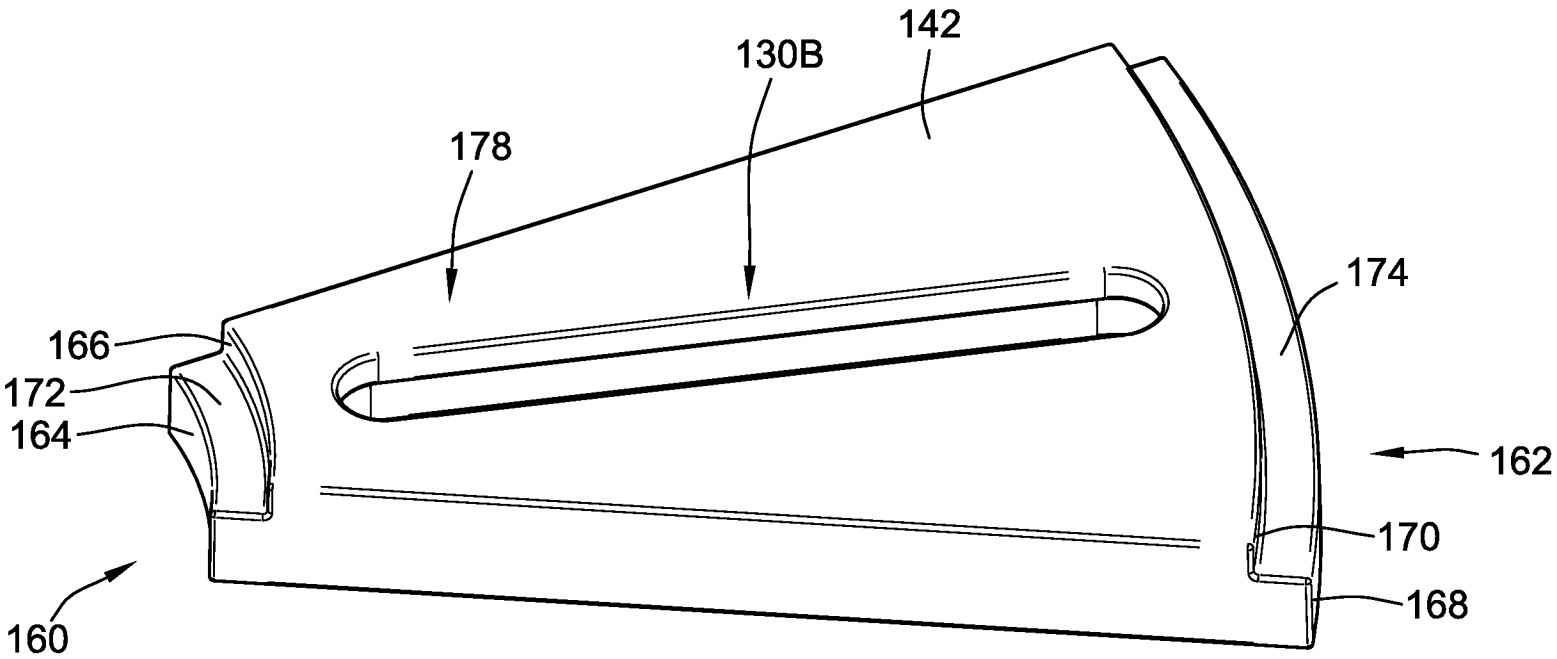
FIG. 5 is a perspective illustration of an adjustable spoke member of the attachment of FIG. 1.

With reference to FIGS. 4 and 5, the radially inner end 160 is stepped and includes a pair of radial abutment surfaces 164, 166 for radially locating with regard to corresponding radially outward facing surfaces of annular wall portion 146 and flange 148. Similarly, radially outer end 162 is stepped includes a pair of radial abutment surfaces 168, 170 for radially locating with regard to corresponding inward facing surfaces of annular wall portion 152 and flange 154. The radially inner end 160 also includes an axial abutment surface 172 for axially locating against an axially facing surface of flange 148. The radially outer end 162 includes an axial abutment surface 174 for axially locating against an axially facing surface of flange 154. Thus, the frame member 124 and the adjustable spoke members 142 have cooperating structures, e.g. cooperating stepped structures, for axially locating and securing the adjustable spoke member 142 relative to the frame member 124. With reference to FIG. 4, the router 100 will be attached to the top side 176 of the frame member 124. The axial abutment surfaces 172, 174 are on a top side 178 of the adjustable spoke members 142 while the corresponding abutment surfaces of flanges 148, 154 are on a bottom side 180 of frame member 124. As such, as the adjustable spoke members 142 are attached to the bottom side 106 of router 100, the adjustable spoke members 142 clamp the frame member 124 to the router 100.

Figure 6:
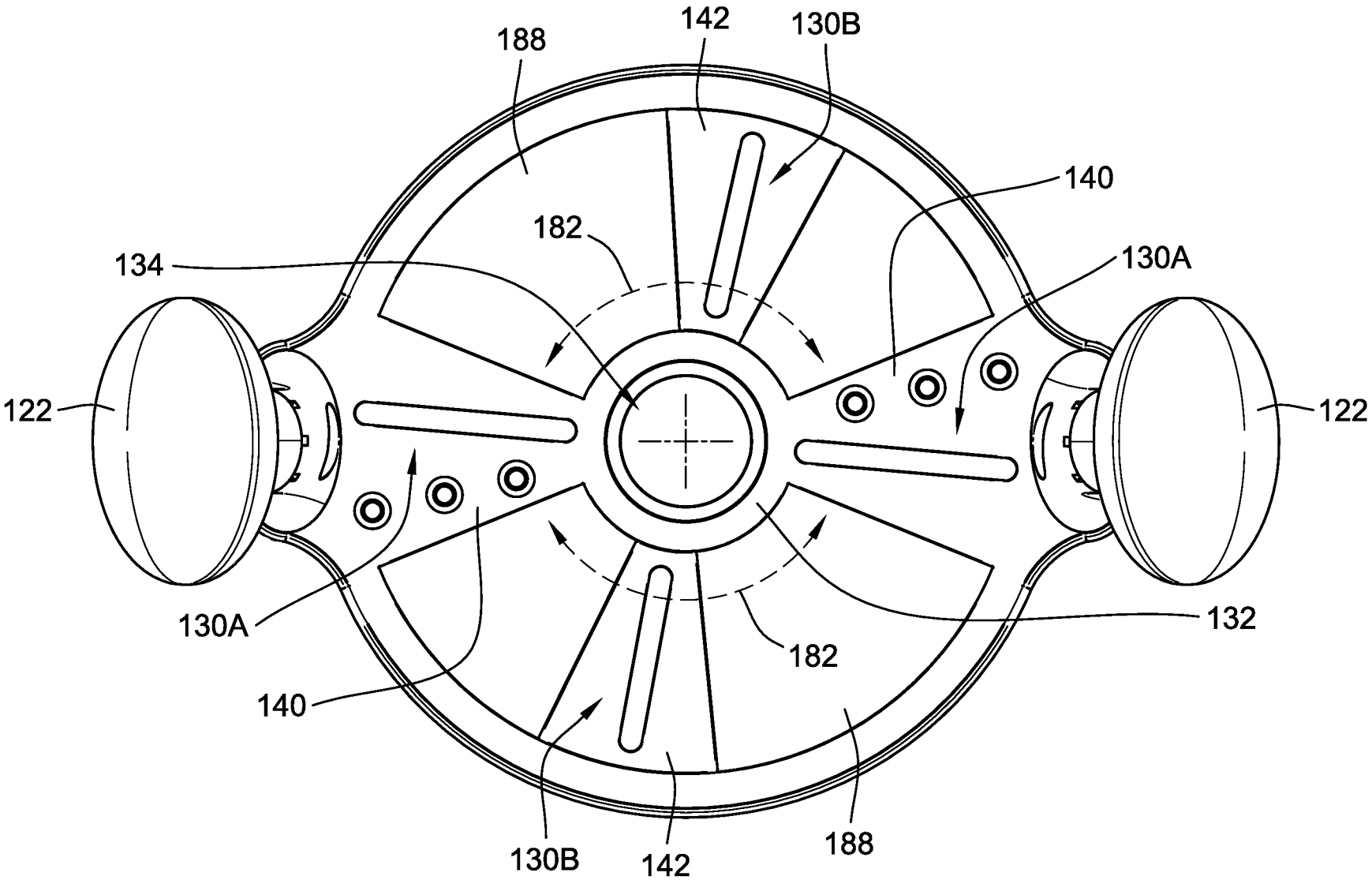
FIG. 6 is a top view of the attachment of FIG. 1.

With additional reference to FIG. 6, the adjustable spoke members 142 may be angularly adjusted about the central aperture 134, as illustrated by arrows 182. The angular adjustment, in combination with the radially extending mounting slots 130B, allow the base 120 to mate with a wide configuration of mounting apertures of different routers. When the bolts extending through mounting slots 130B are tightened, the adjustable spoke members 142 will be axially pressed against flanges 148, 154.

With reference to FIGS. 1 and 4, the base 120 may include an optional cover 188. Cover 188 includes mounting holes 190 that align with holes 191. Bolts/screws can extend through the holes 190 and thread into holes 191 to secure cover 188 over the permanent and adjustable spoke members 140, 142. The cover 188 forms a smooth planar surface to allow the router base 120 to slide over a work piece.

While the present design utilizes two permanent spoke members 140 and two adjustable spoke members 142, it is contemplated that a design could have fewer, or no, permanent spoke members 140. Additionally, it is contemplated that a design could have more than two adjustable spoke members 142.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An attachment for a router having a bit, the attachment comprising:

a frame member having a top side and a bottom side, the frame member having an opening therethrough configured to receive the bit therethrough when the router is attached to the top side of the frame member, the frame member including:

an outer rim;

a central hub located radially inward of the outer rim, the central hub defines the opening;

a permanent spoke member extending between the outer rim and the central hub and connecting the outer rim and the central hub, the permanent spoke member defining a first router mounting aperture, the permanent spoke member being in a fixed position and orientation between the central hub and the outer rim, the first router mounting aperture configured to receive a first attachment member for securing the permanent spoke member to the router; and an adjustable spoke member extending between the outer rim and the central hub, the adjustable spoke member being movable relative to the central hub and the outer rim, the adjustable spoke member defining a second router mounting aperture in the form of a mounting slot, the second router mounting aperture configured to receive a second attachment member for securing the adjustable spoke member to the router, the adjustable spoke member being angularly movable about a central axis of the opening to angularly adjust a position of the adjustable spoke member and the mounting slot relative to the first mounting aperture to change an orientation of the second mounting aperture relative to the permanent spoke member and the first mounting aperture.

2. The attachment of claim 1, wherein the first mounting aperture is a slot.

3. The attachment of claim 1, further comprising a plurality of handles extending from the top side.

4. The attachment of claim 1, further comprising a cover member operably attachable to the bottom side of the frame member, the cover member providing a planar bottom surface for resting on a work piece.

5. The attachment of claim 1, further comprising a second adjustable spoke member defining a third mounting aperture and further comprising a second permanent spoke member defining a further mounting aperture.

6. The attachment of claim 1, wherein the central hub has a radially outward extending flange and the outer rim has a radially inward extending flange, the adjustable spoke member being axially pressed against the radially inward and outward extending flanges when secured to the router.

7. The attachment of claim 6, wherein a position of the adjustable spoke member relative to the radially inward and outward extending flanges is angularly adjustable about the opening.

8. The attachment of claim 1, further comprising:

the first attachment member, the first attachment member configured to extend through the first router mounting aperture and to engage a first mounting aperture of a router; and the second attachment member, the second attachment member configured to extend through the second router mounting aperture and to engage a second mounting aperture of a router.

9. The attachment of claim 1, wherein the permanent spoke member is permanently attached to the central hub and outer rim.

10. The attachment of claim 1, wherein the permanent spoke extends radially between and directly engages the outer rim and the central hub.

11. A method of attaching a router attachment including a frame member having a top side and a bottom side, the frame member having an opening therethrough configured to receive the bit therethrough when the router is attached to the top side of the frame member, the frame member including: an outer rim; a central hub located radially inward of the outer rim, the central hub defines the opening; a permanent spoke member extending between the outer rim and the central hub and connecting the outer rim and the central hub, the permanent spoke member defining a first mounting aperture, the permanent spoke member being in a fixed position and orientation between the central hub and the outer rim; and an adjustable spoke member extending between the outer rim and the central hub, the adjustable spoke member being movable relative to the central hub and the outer rim, the adjustable spoke member defining a second mounting aperture in the form of a mounting slot, the adjustable spoke member being angularly movable about a central axis of the opening to angularly adjust a position of the adjustable spoke member and the mounting slot relative to the first mounting aperture to change an orientation of the second mounting aperture relative to the permanent spoke member and the first mounting aperture to a router, the router having at least two mounting apertures, the method comprising:

aligning one of the first and second mounting apertures of the router attachment with one of the mounting apertures of the router to form a first pair of aligned apertures;

installing an attachment member through the first pair of aligned apertures;

adjusting a position of the second mounting aperture relative to the frame member and the first mounting aperture of the router attachment by changing an angular position of the adjustable spoke member about the central axis of the opening such that the other one of the first and second mounting apertures of the router attachment aligns with another one of the mounting apertures of the router to form a second pair of aligned apertures; and installing an attachment member through the second pair of aligned apertures.

* * * * *